US009828659B2

(12) United States Patent
Na et al.

(10) Patent No.: US 9,828,659 B2
(45) Date of Patent: Nov. 28, 2017

(54) FLUXING METHODS FOR NICKEL BASED CHROMIUM AND PHOSPHORUS BEARING ALLOYS TO IMPROVE GLASS FORMING ABILITY

(71) Applicant: Glassimetal Technology, Inc., Pasadena, CA (US)

(72) Inventors: Jong Hyun Na, Pasadena, CA (US); Michael Floyd, Pasadena, CA (US); Danielle Duggins, Garden Grove, CA (US); Marios D. Demetriou, West Hollywood, CA (US); William L. Johnson, San Marino, CA (US)

(73) Assignee: Glassimetal Technology, Inc., Pasadena, CA (US)

( * ) Notice: Subject to any disclaimer, the term of this patent is extended or adjusted under 35 U.S.C. 154(b) by 388 days.

(21) Appl. No.: 14/565,211

(22) Filed: Dec. 9, 2014

(65) Prior Publication Data

US 2015/0159248 A1 Jun. 11, 2015

Related U.S. Application Data

(60) Provisional application No. 61/913,537, filed on Dec. 9, 2013.

(51) Int. Cl.

| | |
|---|---|
| ***C22C 45/04*** | (2006.01) |
| ***C22C 1/00*** | (2006.01) |
| ***C22C 19/05*** | (2006.01) |
| ***C22F 1/10*** | (2006.01) |

(52) U.S. Cl.

CPC ..... *C22C 45/04* (2013.01); *C22C 1/002* (2013.01); *C22C 19/05* (2013.01); *C22F 1/10* (2013.01)

(58) Field of Classification Search

CPC ..... C22C 45/04; C22C 1/002; C22C 19/05; C22F 1/10

See application file for complete search history.

(56) References Cited

U.S. PATENT DOCUMENTS

| | | | |
|---|---|---|---|
| 3,809,547 | A | 5/1974 | Lewis et al. |
| 4,175,950 | A | 11/1979 | Linares et al. |
| 5,797,443 | A | 8/1998 | Lin et al. |
| 9,534,283 | B2 | 1/2017 | Na et al. |
| 2006/0157164 | A1 | 7/2006 | Johnson et al. |
| 2010/0230012 | A1 | 9/2010 | Demetriou et al. |
| 2013/0048152 | A1 | 2/2013 | Na et al. |
| 2014/0076467 | A1 | 3/2014 | Na et al. |
| 2014/0096874 | A1 | 4/2014 | Weber |
| 2014/0116579 | A1 | 5/2014 | Na et al. |
| 2014/0130945 | A1 | 5/2014 | Na et al. |
| 2014/0190593 | A1 | 7/2014 | Na et al. |
| 2014/0202596 | A1 | 7/2014 | Na et al. |
| 2015/0050181 | A1 | 2/2015 | Na et al. |

OTHER PUBLICATIONS

Murakami (Editor), Stress Intensity Factors Handbook, vol. 2, Oxford: Pergamon Press, 1987, 4 pages.

G.T. Murray, T.A. Lograsso, ASM Handbook, vol. 2: Properties and Selection: Nonferrous Alloys and Special-Purpose Materials, "Preparations and Characterization of Pure Metals," ASM International, 1990, pp. 1093-1097.

*Primary Examiner* — Jessee Roe

(74) *Attorney, Agent, or Firm* — Polsinelli PC

(57) ABSTRACT

The disclosure is directed to Ni-based glass-forming alloys bearing Cr and P, wherein the Cr atomic concentration is greater than 7 percent and the P atomic concentration is greater than 12 percent, and methods of fluxing such alloys such that their glass-forming ability is enhanced with respect to the glass-forming ability associated with their unfluxed state.

17 Claims, 6 Drawing Sheets

FLUXING METHODS FOR NICKEL BASED CHROMIUM AND PHOSPHORUS BEARING ALLOYS TO IMPROVE GLASS FORMING ABILITY

CROSS-REFERENCE TO RELATED APPLICATIONS

The present application claims the benefit of U.S. Provisional Patent Application No. 61/913,537, entitled "Fluxing Methods for Nickel Based Chromium and Phosphorus Bearing Alloys to Improve Glass Forming Ability," filed Dec. 9, 2013, which is incorporated herein by reference in its entirety.

TECHNICAL FIELD

The disclosure relates to nickel-based chromium- and phosphorous-bearing glass forming alloys whose glass-forming ability shows an unexpectedly large improvement after being processed by a fluxing method.

BACKGROUND

Patent application Ser. No. 14/457,821, entitled "A Fluxing Method to Reverse the Adverse Effects of Aluminum Impurities in Nickel-Based Glass-Forming Alloys", filed on Aug. 12, 2014, is directed to a method of fluxing the melt of aluminum-contaminated Ni-metalloid glasses to reverse the adverse effects of aluminum impurities on glass-forming ability and toughness. That provisional patent considers nickel-based glass forming alloys with aluminum weight concentrations in excess of those associated with a high-purity state (i.e. greater than 10 ppm) whose glass-forming ability has been degraded due to the presence of the aluminum impurity, and demonstrates that by processing those alloys by the fluxing method disclosed therein, the glass-forming ability increases to a value associated with the high-purity state. However, patent application Ser. No. 14/457,821 does not address nickel-based glass-forming alloys whose glass-forming ability is degraded even in their high purity unfluxed state, and could potentially be improved by fluxing.

Patent application Ser. No. 14/029,719, entitled "Bulk Nickel-Silicon-Boron Glasses Bearing Chromium", filed on Sep. 17, 2013, discloses that Ni—Cr—Si—B alloys may have improved glass forming ability (GFA) by fluxing with $B_2O_3$ (for example, see FIG. 1 and Table 1). This application demonstrates that Ni-based alloys bearing Cr, but free of P may have critical rod diameters improve by more than 50% when the atomic concentration of Cr is below 7 percent.

BRIEF SUMMARY

The disclosure is directed to Ni-based glass-forming alloys bearing Cr and P, wherein the Cr atomic concentration is greater than 7 percent and the P atomic concentration is greater than 12 percent, and methods of fluxing such Ni-based glass-forming alloys such that the glass forming ability (GFA) of the alloy is improved by at least 50% compared to the alloy in its high purity unfluxed state.

The disclosure is directed to a method of fluxing Ni-based glass-forming alloys bearing Cr and P, wherein the Cr atomic concentration is greater than 7 percent and the P atomic concentration is greater than 12 percent, comprising (1) heating the alloy ingot with a fluxing agent based on boron and oxygen in a crucible to a fluxing temperature that is at least 100° C. above the liquidus temperature of the alloy; (2) allowing the alloy melt to interact with the fluxing agent melt while in contact at the fluxing temperature for a fluxing time of at least 60 seconds; and (3) cooling the two melts to room temperature, and wherein the method improves the glass forming ability of the alloy such that the critical rod diameter of the fluxed alloy increases by at least 50% compared to the critical rod diameter of the alloy in its high purity unfluxed state produced by quenching the melt from the same temperature.

In another embodiment, the total weight fraction of the Al impurity in the alloy in its high purity unfluxed state is less than 10 ppm.

In another embodiment, the Cr atomic concentration is between 7 and 10 percent, and the P atomic concentration is between 14 and 19 percent.

In another embodiment, the critical rod diameter of the fluxed alloy increases by at least 75% compared to that of the alloy in its high purity unfluxed state.

In another embodiment, the critical rod diameter of the fluxed alloy increases by at least 100% compared to that of the alloy in its high purity unfluxed state.

In another embodiment, the fluxing temperature is at least 1150° C.

In another embodiment, the fluxing time is at least 1 hour.

In another embodiment, the fluxing agent is boron oxide.

In another embodiment, the fluxing agent is boric acid.

In yet another embodiment, the fluxing agent has a purity of at least 98%.

In yet another embodiment, the step (3) of cooling the two melts to room temperature is performed sufficiently fast such that the alloy solidifies in an amorphous phase.

In yet another embodiment, the fluxing process is performed in an inert atmosphere.

In another embodiment, the alloy or metallic glass has a composition according to Formula (I) (subscripts denote atomic percent):

$$Ni_{100-a-b-c-d}Cr_aX_bP_cY_d \quad (I)$$

where:

X is Mo, Mn, Nb, Ta, Co, Fe or combinations thereof,

Y is B, Si, or combinations thereof, a is greater than 7 b is between 1 and 5 c is greater than 12, and d is up to 5.

In another embodiment, the alloy or metallic glass has composition according to the Formula (II) (subscripts denote atomic percent):

$$Ni_{100-a-b-c-d-e}Cr_aNb_bP_cB_dSi_e \quad (II)$$

where:

a is between 7 and 10, b is between 2.5 and 3.5, c is between 15.5 and 17.5, d is between 2.5 and 4, and e is up to 1.5.

In yet another embodiment, the disclosure is directed to a metallic glass article produced using an alloy ingot that has been fluxed according to the present method, where the articles have cross sections thicker than metallic glass articles produced with an unfluxed alloy ingot in the high purity unfluxed state.

In some aspects, the critical rod diameter of the fluxed alloys is at least 12 mm. In some aspects, the critical rod diameter of the fluxed alloy is at least 14 mm. In some aspects, the critical rod diameter of the fluxed alloy is at least 16 mm. In some aspects, the critical rod diameter of the fluxed alloy is at least 18 mm.

Additional embodiments and features are set forth in part in the description that follows, and in part will become apparent to those skilled in the art upon examination of the specification or may be learned by the practice of the disclosure. A further understanding of the nature and advantages of the disclosure may be realized by reference to the remaining portions of the specification and the drawings, which form a part of this disclosure.

BRIEF DESCRIPTION OF THE DRAWINGS

The description will be more fully understood with reference to the following figures and data graphs, which are presented as various embodiments of the disclosure and should not be construed as a complete recitation of the scope of the disclosure.

DETAILED DESCRIPTION

Figure 1:
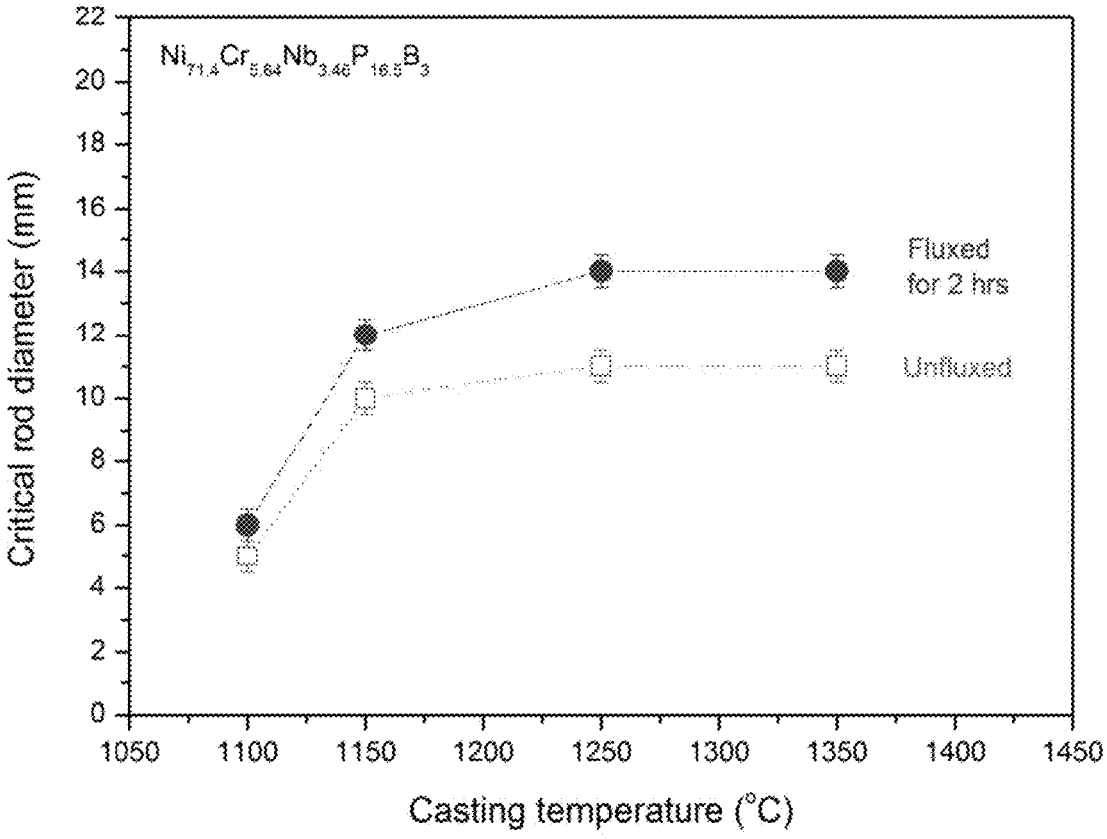
FIG. 1 provides a plot showing the effect of fluxing at various temperatures on the glass-forming ability of alloy $Ni_{71.4}Cr_{5.64}Nb_{3.46}P_{16.5}B_3$, in accordance with embodiments of the disclosure.

The disclosure is directed to Ni-based glass-forming alloys bearing Cr and P, wherein the Cr atomic concentration is greater than 7 percent and the P atomic concentration is greater than 12 percent, and methods of fluxing such alloys such that their glass-forming ability shows an unexpectedly large improvement with respect to the glass-forming ability associated with their high-purity unfluxed state. The glass forming ability is assessed in terms of the maximum diameter of a metallic glass rod that can be formed by melt quenching, defined as the "critical rod diameter," and denoted by $d_{cr}$. In the context of this disclosure, "high purity state" refers to the state of the alloy where the weight concentration of the aluminum impurity in the alloy as formed from the constituent elements (i.e. in the absence of any fluxing) is less than 10 ppm.

In various embodiments, the method of fluxing improves the glass forming ability of the alloy such that the critical rod diameter of the fluxed alloy increases by at least 50% compared to the critical rod diameter of the alloy in its high purity state. In other embodiments, the glass forming ability is improved such that the critical rod diameter of the fluxed alloy increases by at least 75% compared to the critical rod diameter of the alloy in its high purity state, and still other embodiments, the critical rod diameter of the fluxed alloy increases by at least 100% compared to the critical rod diameter of the alloy in its high purity state.

Dehydrated boron oxide is used in this disclosure as the fluxing agent. Specifically, in this disclosure it is demonstrated that certain Ni-based glass forming alloys are so sensitive to impurity inclusions that even in their high purity state, where the concentration of impurity inclusions is relatively low (e.g. 10 ppm or less), their GFA is severely degraded due to the presence of these inclusions. It is further demonstrated that fluxing these alloys with a molten chemical agent based on boron and oxygen at a high enough temperature and for a long enough time, results in an unexpectedly large enhancement in the GFA of such alloys.

Alloys

The method disclosed herein is applicable to any Ni-based metallic glass-forming alloy bearing Cr and P, wherein the Cr atomic concentration is greater than 7 percent and the P atomic concentration is greater than 12 percent, including but not limited to, Ni—Cr—Nb—P—B, Ni—Cr—Nb—P—Si, Ni—Cr—Ta—P—B, Ni—Cr—Mn—P—B. The alloys can also have the composition of Formula (I) or Formula (II), as described herein.

To demonstrate the effects of the current fluxing method in improving GFA, the family of Ni—Cr—Nb—P—B—(Si) glass forming alloys, disclosed in a recent applications (U.S. patent application Ser. No. 13/592,095, entitled "Bulk Nickel-Based Chromium and Phosphorous Bearing Metallic Glasses," filed on Aug. 22, 2012, and U.S. patent application Ser. No. 14/067,521, entitled "Bulk Nickel-Based Chromium and Phosphorous Bearing Metallic Glasses with High Toughness," filed on Oct. 30, 2013, which are incorporated herein by reference), is described.

The "high-purity state" of the alloy is referred to herein as the state achieved by creating the alloy using high-purity elements (where specific elemental purities used to create the high-purity state are described in the Section "Description of Methods Used to Investigate the Effects of Fluxing") in the absence of any fluxing. The effect of fluxing temperature over fixed fluxing time on the GFA of alloys $Ni_{71.4}Cr_{5.64}Nb_{3.46}P_{16.5}B_3$ and $Ni_{68.17}Cr_{8.65}Nb_{2.98}P_{16.42}B_{3.28}Si_{0.5}$ was investigated. The fluxing temperature was varied in the range of 1100 to 1350° C. while the fluxing time was held constant at 2 hours. For each composition, the GFA data for the fluxed samples is contrasted to the GFA data for the unfluxed samples in their high purity state for various temperatures in FIGS. 1 and 2.

Metallic Glasses

In various aspects, the disclosure is directed to a metallic glass having a higher thickness at its shortest dimension than heretofore described. In some aspects, metallic glasses have the composition of Formula (I):

$$Ni_{100-a-b-c-d}Cr_aX_bP_cY_d \quad (I)$$

wherein:

X is Mo, Mn, Nb, Ta, Co, Fe or combinations thereof, Y is B, Si, or combinations thereof. The atomic percent of Cr (a) is greater than 7, the atomic percent of X (b) is between 1 and 5, the atomic percent of P (c) is greater than 12, and the atomic percent of Y (d) is up to 5. In other embodiments, the metallic glasses can comprise a fluxed alloy of $Ni_{100-a-b-c-d-e}Cr_aNb_bP_cB_dSi_e$ where the atomic percent of Cr (a) is between 7 and 10, the atomic percent of X (b) is between 2.5 and 3.5, the atomic percent of P (c) is between 15.5 and 17.5, and the atomic percent of B (d) is between 2.5 and 4, and the atomic percent of Si (e) is up to 1.5.

In further aspects, the metallic glass has composition of Formula (II):

$$Ni_{100-a-b-c-d-e}Cr_aNb_bP_cB_dSi_e, \quad (II)$$

Wherein:

the atomic percent of Cr (a) is 7 and 10, the atomic percent of Nb (b) is between 2.5 and 3.5, the atomic percent of P (c) is between 14 and 17.5, the atomic percent of B (d) is between 2.5 and 4, and the atomic percent of Si (e) is up to 1.5.

In various embodiments, the metallic glasses, including those of Formula (I) and Formula (II) have a thickness at its shortest dimension of at least 12 mm. In other embodiments, the metallic glasses have a thickness at its shortest dimension of at least 13 mm, and in still other embodiments, the thickness at its shortest dimension is at least 14 mm.

The data for $Ni_{71.4}Cr_{5.64}Nb_{3.46}P_{16.5}B_3$ is shown in FIG. 1. The glass-forming ability of alloy $Ni_{71.4}Cr_{5.64}Nb_{3.46}P_{16.5}B_3$ in its high purity unfluxed state increases with overheating the melt temperature. Specifically, when the melt in its high purity unfluxed state is heated to 1100° C. prior to quenching to form a glass, the critical rod diameter is 5 mm, while when the melt is heated to 1250° C. or higher prior to quenching, the critical rod diameter is 11 mm (open squares in FIG. 1). On the other hand, when the melt is heated to 1100° C. while being fluxed and held for 2 hours prior to quenching to form a glass, the critical rod diameter is 6 mm, while when the melt is heated to 1250° C. or higher and held for 2 hours prior to quenching, the critical rod diameter is 14 mm (solid circles in FIG. 1). Therefore, the GFA of fluxed $Ni_{71.4}Cr_{5.64}Nb_{3.46}P_{16.5}B_3$ reaches a plateau at 14 mm, which represents about 27% improvement with respect to the plateau in glass-forming ability of unfluxed $Ni_{71.4}Cr_{5.64}Nb_{3.46}P_{16.5}B_3$ of 11 mm.

Figure 2:
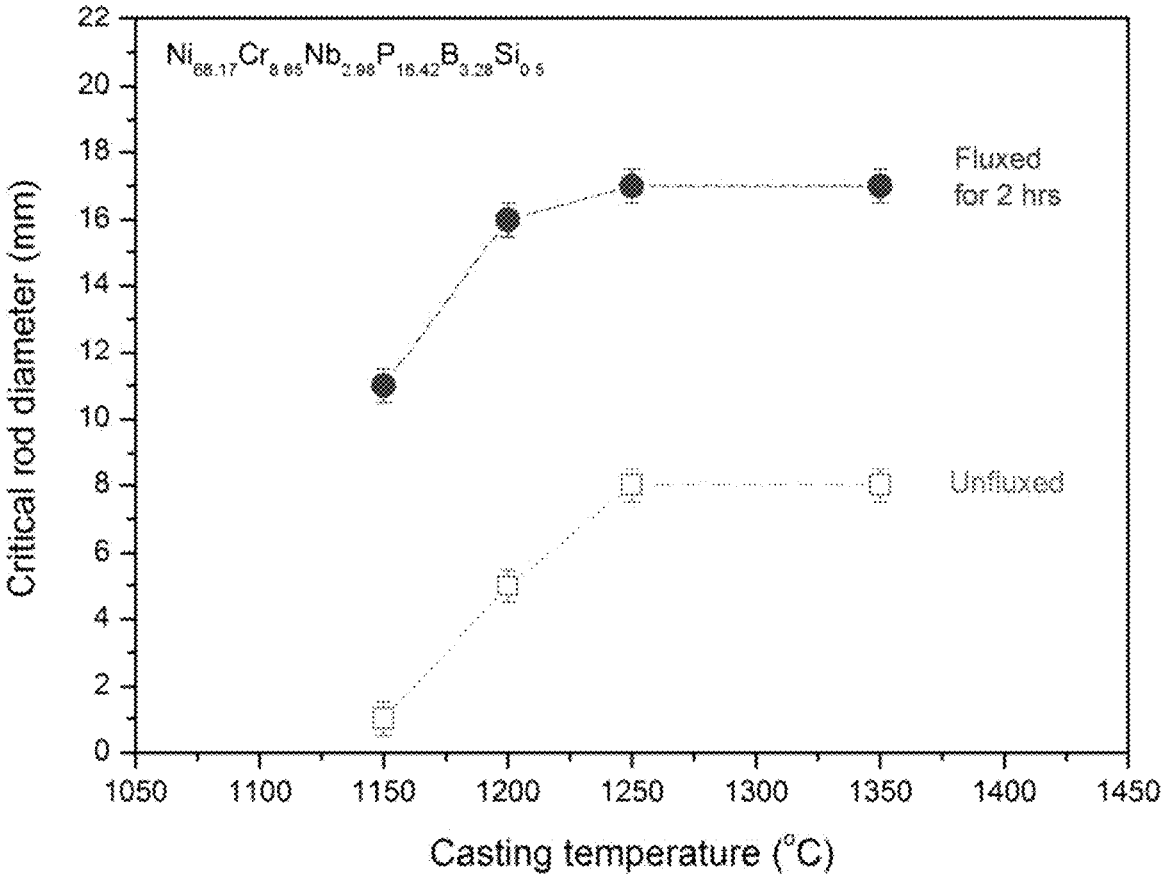
FIG. 2 provides a plot showing the effect of fluxing at various temperatures on the glass-forming ability of alloy $Ni_{68.17}Cr_{8.65}Nb_{2.98}P_{16.42}B_{3.28}Si_{0.5}$, in accordance with embodiments of the disclosure.
Figure 3:
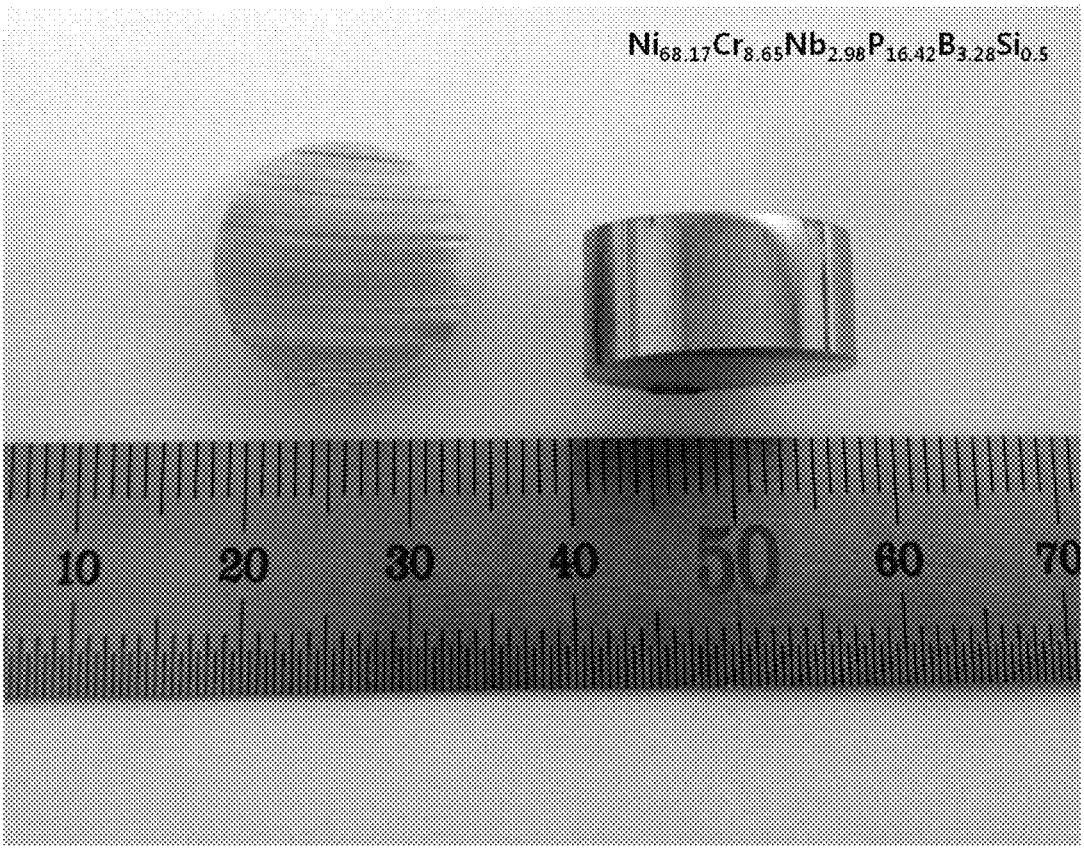
FIG. 3 provides an image of a 17-mm rod of $Ni_{68.17}Cr_{8.65}Nb_{2.98}P_{16.42}B_{3.28}Si_{0.5}$ metallic glass, in accordance with embodiments of the disclosure.
Figure 4:
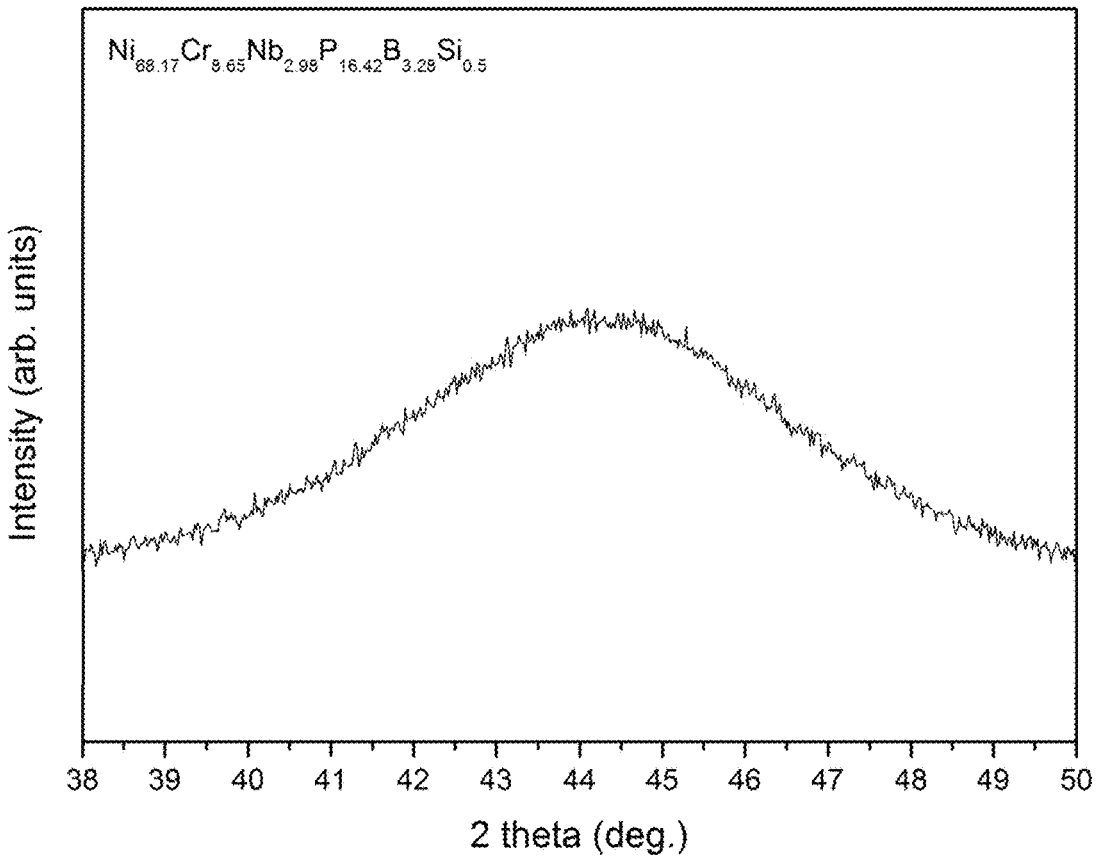
FIG. 4 provides an x-ray diffractogram verifying the amorphous structure of a 17-mm rod of $Ni_{68.17}Cr_{8.65}Nb_{2.98}P_{16.42}B_{3.28}Si_{0.5}$ metallic glass, in accordance with embodiments of the disclosure.
Figure 5:
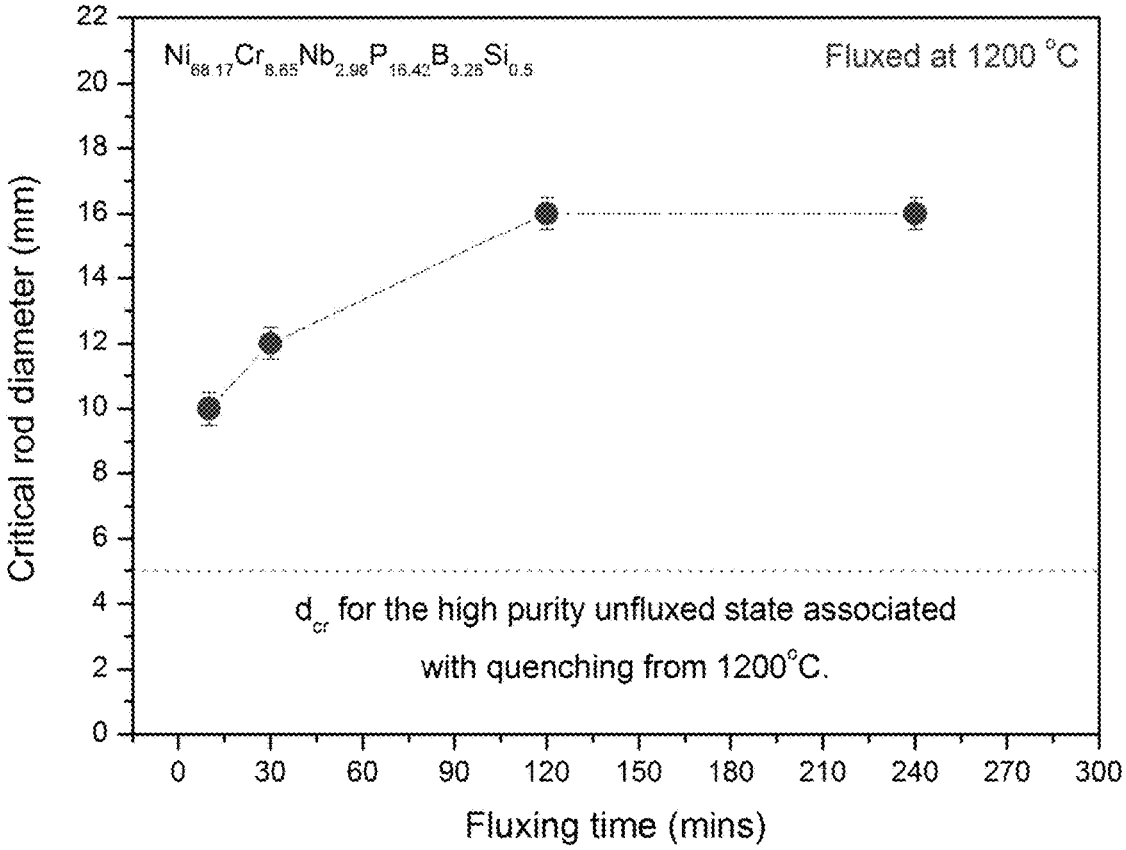
FIG. 5 provides a plot showing the effect of fluxing on GFA by varying fluxing time while keeping the fluxing temperature constant for alloy $Ni_{68.17}Cr_{8.65}Nb_{2.98}P_{16.42}B_{3.28}Si_{0.5}$, in accordance with embodiments of the disclosure.

The data for $Ni_{68.17}Cr_{8.65}Nb_{2.98}P_{16.42}B_{3.28}Si_{0.5}$ is shown in FIG. 2. When the melt in its high purity unfluxed state is heated to 1150° C. prior to quenching to form a glass, the critical rod diameter is just 1 mm, while when the melt is heated to 1250° C. or higher prior to quenching, the critical rod diameter is 8 mm (open squares in FIG. 2). On the other hand, when the melt is heated to 1150° C. while being fluxed and held for 2 hours prior to quenching to form a glass, the critical rod diameter is 11 mm, while when the melt is heated to 1250° C. or higher and held for 2 hours prior to quenching, the critical rod diameter is 17 mm (solid circles in FIG. 2). Therefore, the GFA of fluxed $Ni_{68.17}Cr_{8.65}Nb_{2.98}P_{16.42}B_{3.28}Si_{0.5}$ reaches a plateau at 17 mm, which represents about 113% improvement with respect to the plateau in glass-forming ability of unfluxed $Ni_{68.17}Cr_{8.65}Nb_{2.98}P_{16.42}B_{3.28}Si_{0.5}$ of 8 mm. An image of a 17-mm rod of $Ni_{68.17}Cr_{8.65}Nb_{2.98}P_{16.42}B_{3.28}Si_{0.5}$ metallic glass is shown in FIG. 3, while an x-ray diffractogram verifying its amorphous structure is shown in FIG. 4.

Therefore, FIGS. 1 and 2 demonstrate that within the same alloy family, certain alloys (e.g. $Ni_{71.4}Cr_{5.64}Nb_{3.46}P_{16.5}B_3$) only show marginal improvement in GFA by fluxing, while other alloys (e.g. $Ni_{68.17}Cr_{8.65}Nb_{2.98}P_{16.42}B_{3.28}Si_{0.5}$) demonstrate dramatic improvement in GFA by fluxing. The GFA data for these two alloys is listed in Table 1 along with data from three other alloys from the same alloy family. These are $Ni_{69}Cr_{8.5}Nb_3P_{16.5}B_3$ and $Ni_{68.6}Cr_{8.7}Nb_3P_{16}B_{3.2}Si_{0.5}$, which also show large improvements in GFA by fluxing of 80% and 91% respectively, and alloy $Ni_{71.4}Cr_{5.52}Nb_{3.38}P_{16.67}B_{3.03}$, which demonstrates only minor improvement in GFA by fluxing of just 27%.

It can hence be concluded that fluxing has a much more significant effect on GFA on alloys with high Cr content (Cr atomic concentration>7%) as compared to alloys with low Cr content (Cr atomic concentration<7%). In general, when fluxed according to the present embodiments, alloys with high Cr content may exhibit critical rod diameter greater than 15 mm while alloys with low Cr content may exhibit critical rod diameter less than 15 mm. This result essentially implies that in the high purity state, the GFA of alloys with a low Cr content is not severely affected by inclusions, and as such, fluxing brings about only modest improvements in GFA. By contrast, the GFA of alloys with a high Cr content are much more heavily influenced by inclusions in the high purity state, and as such, fluxing unexpectedly results in greater improvements in GFA than observed for alloys with low Cr content.

The present results are in direct contrast to the results obtained in patent application Ser. No. 14/029,719, where the GFA of Ni—Cr—Si—B alloys with low Cr content (Cr atomic concentration<7%) showed a larger improvement by fluxing as compared to alloys with high Cr content (Cr atomic concentration>7%). Therefore, this very uneven effect of fluxing on GFA between alloys from the same alloy family is unpredictable, as there is no guidance as to how one could predict it.

TABLE 1

Effect of fluxing at 1350° C. for 2 hours on the glass forming ability of Ni—Cr—Nb—P— B—(Si) alloys.

| Alloy composition | $d_{cr}$ (unfluxed) [mm] | $d_{cr}$ (fluxed) [mm] | % increase |
|---|---|---|---|
| $Ni_{69}Cr_{8.5}Nb_3P_{16.5}B_3$ | 10 | 18 | 80% |
| $Ni_{68.6}Cr_{8.7}Nb_3P_{16}B_{3.2}Si_{0.5}$ | 11 | 21 | 91% |
| $Ni_{68.17}Cr_{8.65}Nb_{2.98}P_{16.42}B_{3.28}Si_{0.5}$ | 8 | 17 | 113% |
| $Ni_{71.4}Cr_{5.64}Nb_{3.46}P_{16.5}B_3$ | 11 | 14 | 27% |
| $Ni_{71.4}Cr_{5.52}Nb_{3.38}P_{16.67}B_{3.03}$ | 11 | 14 | 27% |

The effect on GFA of varying fluxing time while keeping the fluxing temperature constant is also investigated for alloy $Ni_{68.17}Cr_{8.65}Nb_{2.98}P_{16.42}B_{3.28}Si_{0.5}$. The fluxing time was varied between 10 and 240 minutes. The fluxing temperature was 1200° C. for all experiments. The results are plotted in FIG. 3. The critical rod diameter corresponding to the high purity unfluxed state of the alloy when quenched from 1200° C. is 5 mm, and is designated in FIG. 3 by a dotted line. Fluxing the alloy for 10 minutes at 1200° C. increased the critical rod diameter to 10 mm; fluxing for 30 minutes increases $d_{cr}$ to 12 mm; fluxing for 120 minutes or longer increased $d_{cr}$ to 16 mm. These results demonstrate that the fluxing effect on GFA is not only temperature dependent, but also time dependent, as expected from reaction rate theory. The GFA basically is shown to reach a plateau by either increasing the fluxing temperature while keeping the fluxing time constant (e.g. FIGS. 1 and 2), or increasing the fluxing time while keeping the fluxing temperature constant (e.g. FIG. 3).

Figure 6:
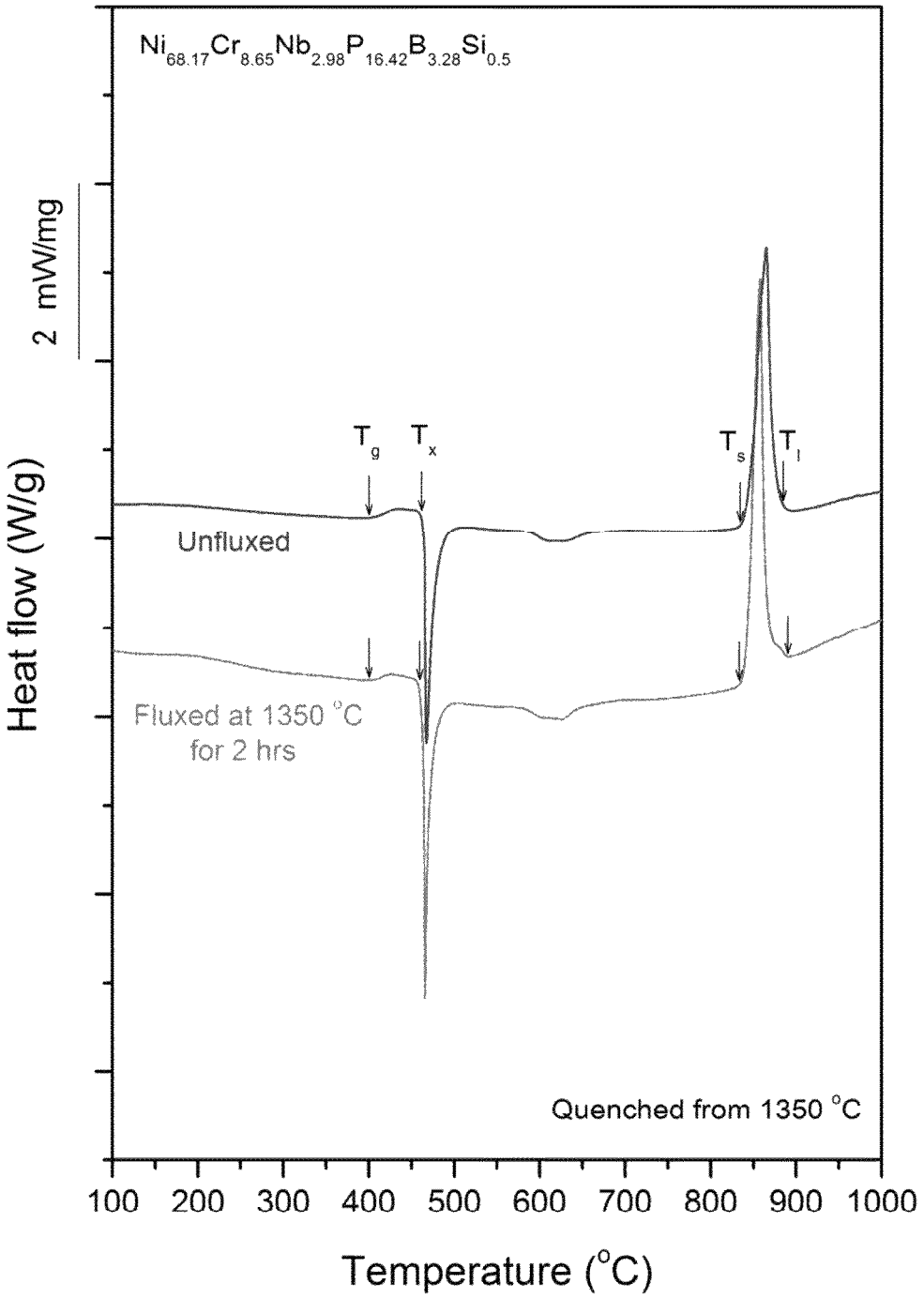
FIG. 6 provides a plot showing calorimetry scans at a heating rate of 20° C. per minute for metallic glass $Ni_{68.17}Cr_{8.65}Nb_{2.98}P_{16.42}B_{3.28}Si_{0.5}$ in the high-purity unfluxed state, and after being fluxed for about 2 hours at 1350° C. according the current fluxing method, in accordance with embodiments of the disclosure. Arrows designate $T_g$, $T_x$, $T_s$, and $T_l$.

Lastly, differential scanning calorimetry was performed at a scanning rate of 20 degrees per minute to investigate the effects of fluxing on the glass-transition temperature $T_g$, crystallization temperature $T_x$, solidus temperature $T_s$, and liquidus temperature $T_l$ of metallic glass $Ni_{68.17}Cr_{8.65}Nb_{2.98}P_{16.42}B_{3.28}Si_{0.5}$. In FIG. 6, the calorimetry scan for metallic glass $Ni_{68.17}Cr_{8.65}Nb_{2.98}P_{16.42}B_{3.28}Si_{0.5}$ fluxed for 2 hours at 1350° C. is compared against that for the high purity unfluxed state of the metallic glass. The values of $T_g$, $T_x$, $T_s$, and $T_l$ for the two scans are listed in Table 2. As shown in FIG. 6 and Table 2, fluxing the alloy for 2 hours at 1350° C. has a negligible effect on the $T_g$, $T_x$, $T_s$, and $T_l$.

TABLE 2

Effect of fluxing on the glass-transition, crystallization, solidus, and liquidus temperatures of $Ni_{68.17}Cr_{8.65}Nb_{2.98}P_{16.42}B_{3.28}Si_{0.5}$.

| Metallic glass or alloy composition | Fluxing | $T_g$ (° C.) | $T_x$ (° C.) | $T_s$ (° C.) | $T_l$ (° C.) |
|---|---|---|---|---|---|
| $Ni_{68.17}Cr_{8.65}Nb_{2.98}P_{16.42}B_{3.28}Si_{0.5}$ | Un-fluxed | 400 | 462 | 834 | 884 |
| | Fluxed at 1350° C. for 2 hrs | 400 | 460 | 834 | 889 |

Description of Methods Used to Investigate the Effects of Fluxing

The specific method used to produce the example alloy ingots involves inductive melting of the appropriate amounts of elemental constituents in a fused silica crucible under inert atmosphere. The specific purity levels of the constituent elements used to create the high-purity state in the example alloys were as follows: Ni 99.995% (0.05 ppm Al), Cr 99.996% (0 ppm Al), Nb 99.95% (0 ppm Al), B 99.5% (0.032 atomic percent Al), P 99.9999% (0 ppm Al), and Si 99.9999% (0 ppm Al). The total weight fraction of the aluminum impurity in the high-purity unfluxed state of all alloys investigated in the disclosure is under 10 ppm.

The specific method used to process the example alloys in their unfluxed high purity state into metallic glass rods involves re-melting the alloy ingots in quartz tubes of a specific inner diameter and wall thickness of 0.5 mm in a furnace under high purity argon. After heating the melt to a specific temperature above the alloy liquidus temperature, the melt is rapidly quenching in a room-temperature water bath.

The specific fluxing method used to process the example alloys into metallic glass rods involves melting the alloy ingots in contact with boron oxide (99.999%, 200 ppm H2O) in a quartz tube of a specific inner diameter and wall thickness of 0.5 mm under high purity argon, holding the alloy melt and the boron oxide melt to a specific fluxing temperature and allowing them to interact for a specific fluxing time, and subsequently quenching in a bath of room temperature water.

Having described several embodiments, it will be recognized by those skilled in the art that various modifications, alternative constructions, and equivalents may be used without departing from the spirit of the disclosure. Additionally, a number of well-known processes and elements have not been described in order to avoid unnecessarily obscuring the disclosure. Accordingly, the above description should not be taken as limiting the scope of the disclosure.

Those skilled in the art will appreciate that the presently disclosed embodiments teach by way of example and not by limitation. Therefore, the matter contained in the above description or shown in the accompanying drawings should be interpreted as illustrative and not in a limiting sense. The following claims are intended to cover all generic and specific features described herein, as well as all statements of the scope of the present method and system, which, as a matter of language, might be said to fall therebetween.

The invention claimed is:

1. A method of fluxing a high purity Ni-based glass-forming alloy bearing Cr and P, wherein the Cr atomic concentration is greater than 7 percent and the P atomic concentration is greater than 12 percent, comprising:

heating the alloy with a fluxing agent comprising boron and oxygen to a fluxing temperature that is above the liquidus temperature of the alloy and above the softening or melting temperature of the fluxing agent to form an alloy melt and a fluxing agent melt;

allowing the alloy melt to interact with the fluxing agent melt at the fluxing temperature to form a fluxed alloy;

cooling the fluxed alloy to a temperature below the glass transition temperature of the alloy; wherein the critical rod diameter of the fluxed alloy is increased by at least 50% as compared to the critical rod diameter of the alloy comprising the same composition in its unfluxed high-purity state.

2. The method of claim 1, wherein the critical rod diameter of the fluxed alloy is increased by at least 75% as compared to the critical rod diameter of the alloy comprising the same composition in its unfluxed high-purity state.

3. The method of claim 1, wherein the critical rod diameter of the fluxed alloy is increased by at least 100% as compared to the critical rod diameter of the alloy comprising the same composition in its unfluxed high-purity state.

4. The method of claim 1, wherein the critical rod diameter of the fluxed alloy is at least 14 mm.

5. The method of claim 1, wherein the critical rod diameter of the fluxed alloy is at least 16 mm.

6. The method of claim 1, wherein the fluxing temperature is at least 100° C. above the liquidus temperature of the alloy.

7. The method of claim 1, wherein the fluxing temperature is at least 1150° C.

8. The method of claim 1, wherein the alloy melt interacts with the fluxing agent at the fluxing temperature for a fluxing time of at least 60 seconds.

9. The method of claim 6, wherein the fluxing time is at least 1 hour.

10. The method of claim 1, wherein the fluxing agent is boron oxide.

11. The method of claim 1, wherein the fluxing agent is boric acid.

12. The method of claim 1, the fluxing agent has a purity of at least 98%.

13. The method of claim 1, wherein the cooling of the fluxed alloy is sufficiently fast such that the fluxed alloy solidifies in an amorphous phase.

14. The method of claim 1, wherein the fluxing method is performed in an inert atmosphere.

15. The method of claim 1, wherein the Cr atomic concentration is between 7 and 10, and the P atomic concentration is between 14 and 19.

16. The method of claim 1, wherein the alloy has a composition according to Formula (I):

$$Ni_{(100-a-b-c-d)}Cr_aX_bP_cY_d, \quad (I)$$

wherein X is Mo, Mn, Nb, Ta, Fe or combinations thereof,
Y is B, Si, or combinations thereof,
the atomic percent of Cr (a) is greater than 7,
the atomic percent of X (b) is between 1 and 5,
the atomic percent of P (c) is greater than 12,
and the atomic percent of Y (d) is up to 5.

17. The method of claim 1, wherein the alloy has a composition according to Formula (II):

$$Ni_{100-a-b-c-d-e}Cr_aNb_bP_cB_dSi_e, \quad (II)$$

wherein the atomic percent of Cr (a) is 7 and 10,
the atomic percent of Nb (b) is between 2.5 and 3.5,
the atomic percent of P (c) is between 14 and 17.5,
the atomic percent of B (d) is between 2.5 and 4, and
the atomic percent of Si (e) is up to 1.5.

* * * * *